US009046271B2

(12) United States Patent
Hernandez et al.

(10) Patent No.: US 9,046,271 B2
(45) Date of Patent: Jun. 2, 2015

(54) MULTIPOINT INJECTOR FOR A TURBINE ENGINE COMBUSTION CHAMBER

(75) Inventors: Didier Hippolyte Hernandez, Moissy-Cramayel Cedex (FR); Thomas Olivier Marie Noel, Moissy-Cramayel Cedex (FR)

(73) Assignee: SNECMA, Paris (FR)

( * ) Notice: Subject to any disclaimer, the term of this patent is extended or adjusted under 35 U.S.C. 154(b) by 514 days.

(21) Appl. No.: 13/501,385

(22) PCT Filed: Oct. 12, 2010

(86) PCT No.: PCT/FR2010/000682

§ 371 (c)(1),
(2), (4) Date: Apr. 11, 2012

(87) PCT Pub. No.: WO2011/045486

PCT Pub. Date: Apr. 21, 2011

(65) Prior Publication Data

US 2012/0198852 A1 Aug. 9, 2012

(30) Foreign Application Priority Data

Oct. 13, 2009 (FR) ..... 09 04907

(51) Int. Cl.
*F02C 1/00* (2006.01)
*F02G 3/00* (2006.01)
(Continued)

(52) U.S. Cl.
CPC ..... *F23R 3/283* (2013.01); *F23D 11/36* (2013.01); *F23D 2900/00016* (2013.01); *F23R 3/343* (2013.01)

(58) Field of Classification Search
CPC ..... F23R 3/286; F23R 3/32; F23R 3/222; F23R 3/283; F23R 3/28; F23R 3/14; F23R 3/34; F23R 3/38; F23R 3/30
USPC ..... 60/737–748
See application file for complete search history.

(56) References Cited

U.S. PATENT DOCUMENTS 4,754,600 A 7/1988 Barbier et al.
7,506,510 B2 * 3/2009 Thomson ..... 60/740
(Continued)

FOREIGN PATENT DOCUMENTS

EP 0 239 462 9/1987
EP 1 314 933 5/2003
EP 1 806 536 7/2007
(Continued)

OTHER PUBLICATIONS

U.S. Appl. No. 13/501,526, filed Apr. 12, 2012, Hernandez, et al.
(Continued)

*Primary Examiner* — Craig Kim
(74) *Attorney, Agent, or Firm* — Oblon, McClelland, Maier & Neustadt, L.L.P.

(57) ABSTRACT

A fuel injector device for an annular combustion chamber including a pilot circuit feeding an injector and a multipoint circuit feeding injection orifices formed in a front face of an annular chamber, an annular ring being mounted in the annular chamber to define therein a fuel feed circuit for the injection orifices and a cooling circuit operating by passing the fuel feeding the injector and extending over the front face of the chamber in immediate vicinity of the injection orifices.

11 Claims, 2 Drawing Sheets

(51) Int. Cl.

| | |
|---|---|
| ***F23R 3/28*** | (2006.01) |
| ***F23D 11/36*** | (2006.01) |
| ***F23R 3/34*** | (2006.01) |

(56) References Cited

U.S. PATENT DOCUMENTS

| | | | | |
|---|---|---|---|---|
| 2003/0131600 | A1 | 7/2003 | David et al. | |
| 2004/0250547 | A1 * | 12/2004 | Mancini et al. | 60/740 |
| 2007/0157616 | A1 | 7/2007 | Hernandez et al. | |
| 2009/0038312 | A1 | 2/2009 | Hernandez et al. | |

FOREIGN PATENT DOCUMENTS

| | | |
|---|---|---|
| EP | 2 026 002 | 2/2009 |
| FR | 2 673 705 | 9/1992 |

OTHER PUBLICATIONS

French Search Report Issued May 5, 2010 in FR 09 04907 Filed Oct. 13, 2009.

International Search Report Issued Feb. 17, 2011 in PCT/FR10/00682 Filed Oct. 12, 2010.

* cited by examiner

MULTIPOINT INJECTOR FOR A TURBINE ENGINE COMBUSTION CHAMBER

BACKGROUND OF THE INVENTION

1. Field of the Invention

The present invention relates to a "multipoint" fuel injector device for an annular combustion chamber of a turbine engine such as an airplane turboprop or turbojet.

2. Description of the Related Art

In known manner, a turbine engine has an annular combustion chamber arranged at the outlet from a high-pressure compressor and provided with a plurality of fuel injector devices that are regularly distributed circumferentially at the inlet of the combustion chamber. Each multipoint injector device comprises both a first venturi, within which a pilot injector is mounted centrally on the axis of the first venturi, which injector is fed continuously with fuel by a pilot circuit, and also a second venturi that is arranged coaxially around the first venturi. This second venturi has an annular chamber at its upstream end within which an annular ring is mounted, the ring being fed with fuel by a multipoint circuit. The ring has fuel injection orifices formed in a front face that faces downstream and towards the outside of the second venturi.

The pilot circuit delivers a continuous flow of fuel at a rate that is optimized for low speeds, and the multipoint circuit delivers fuel at an intermittent rate that is optimized for high speeds.

Nevertheless, under the effect of the high temperatures due to the radiation from the flame in the combustion chamber, using an intermittent multipoint circuit presents the major drawback of giving rise to any fuel that stagnates inside the multipoint circuit clogging or coking when the multipoint circuit is switched off. These phenomena can give rise to coke being formed in the ring and in the fuel injection orifices of the multipoint circuit, thereby adversely affecting the spraying of fuel from the multipoint circuit, and thus affecting the operation of the combustion chamber.

In order to reduce this risk of coking, it is known from document EP 2 026 002 in the name of the Applicant to make use of the fuel pilot circuit to cool the multipoint circuit so as to reduce the formation of coke therein, by using two annular channels that are formed in the annular chamber radially inside and outside the annular ring, these two channels having their outlets connected to the pilot injector.

Nevertheless, such a configuration does not achieve a satisfactory reduction in the risk of coking for the fuel that flows over the front face of the annular chamber, since said fuel remains strongly exposed to the thermal radiation generated by the combustion of fuel downstream therefrom.

BRIEF SUMMARY OF THE INVENTION

A particular object of the invention is to provide a solution to this problem that is simple, effective, and inexpensive.

To this end, the invention provides a fuel injector device for an annular combustion chamber of a turbine engine, the device comprising a pilot circuit continuously feeding an injector leading into a first venturi and a multipoint circuit intermittently feeding injection orifices formed in a front face of an upstream annular chamber of a second venturi coaxial about the first venturi, an annular ring being mounted in the annular chamber to define therein a fuel feed circuit for feeding the injection orifices and a cooling circuit operating by passing the fuel that feeds the injector of the pilot circuit, the injector device being characterized in that the cooling circuit extends over the front face of the chamber in the immediate vicinity of the injection orifices.

Incorporating a portion of the cooling circuit in the front face of the annular chamber that is the most exposed to thermal radiation enables that portion of said front face that is in the immediate vicinity of the injection orifices to be cooled continuously in order to avoid the orifices coking.

Advantageously, a portion of the cooling circuit is formed by a groove in a downstream face of the annular ring, this downstream face being pressed against the front face of the annular chamber.

This enables the cooling circuit for the front face of the annular chamber to be made in simple manner and at low cost.

The cooling circuit also comprises an annular channel formed between the inner cylindrical walls of the ring and of the annular chamber, in order to cool the inner cylindrical face of the annular chamber of the second venturi through which there flows a stream of hot air coming from the high-pressure compressor.

The cooling circuit also includes an annular channel formed between the outer cylindrical walls of the annular ring and of the annular chamber, which channel may serve to cool the outer wall of the annular chamber by a flow of fuel from the pilot circuit, or else may be designed to be isolated from the pilot circuit and to be filled in operation with air or with coked fuel acting as a thermal insulator.

In operation, the outer periphery of the annular chamber of the second venturi is subjected to temperatures that are lower than the temperatures of the inner periphery of the annular chamber, so there is no need to cool the outline of the annular chamber continuously, and it is found that using a thermal insulator suffices.

In a preferred embodiment of the invention, the cooling circuit for cooling the front face of the chamber is of undulating shape and extends in alternation radially inside and outside the injection orifices, thereby enabling the cooling circuit to be positioned as close as possible to the injection orifices.

Advantageously, the cooling circuit for cooling the front face of the chamber comprises two symmetrical semicircular branches, each extending between fuel inlet means and fuel outlet means, which fuel outlet means are connected to the injector of the pilot circuit.

Fuel injection through the orifices in the annular chamber is achieved by means of orifices in the ring that lead into the orifices of the annular chamber.

Advantageously, the orifices in the downstream wall of the ring present a diameter that is less than the diameter of the orifices in the front face of the annular chamber, thereby avoiding drops of fuel leaving the orifices in the ring coking while the multipoint circuit is switched off, and thereby closing off the orifices in the chamber wall.

The invention also provides an annular combustion chamber for a turbine engine that includes at least one fuel injector device of the above-described type.

The invention also provides a turbine engine, such as a turboprop or a turbojet, the engine including at least one fuel injector device of the above-described type.

BRIEF DESCRIPTION OF THE SEVERAL VIEWS OF THE DRAWINGS

The invention can be understood and other details, advantages, and characteristics of the invention appear on reading the following description made by way of non-limiting example with reference to the accompanying drawings, in which.

DETAILED DESCRIPTION OF THE INVENTION

Figure 1:
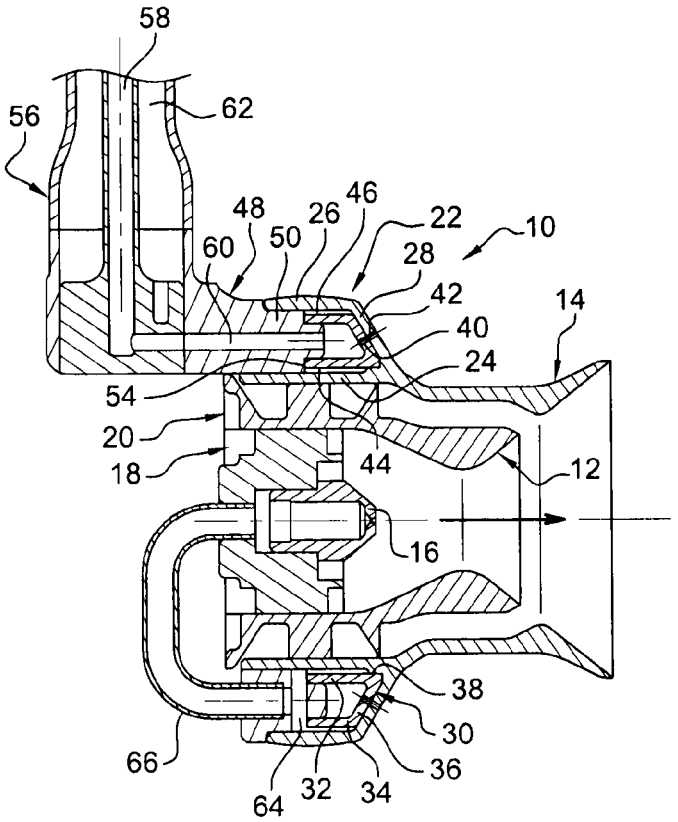
FIG. 1 is a fragmentary diagrammatic axial section view of a prior art multipoint fuel injector device.

Reference is made initially to FIG. 1, which shows an injector device 10 having two fuel injector systems, one of which is a pilot system that operates continuously, and the other of which is a multipoint system that operates intermittently. The device is for mounting in an opening in an end wall of an annular combustion chamber of a turbine engine, which combustion chamber is fed with air by an upstream high-pressure compressor and delivers combustion gas to a turbine mounted downstream.

The device comprises a first venturi 12 and a second venturi 14 arranged coaxially with the first venturi 12 mounted inside the second venturi 14. A pilot injector is mounted inside a first stage of swirlers 18 inserted axially inside the first venturi 12. A second stage of swirlers 20 is formed at the upstream end of the first venturi 12 and radially on the outside thereof so as to extend between the first and second venturies 12 and 14.

The second venturi 14 has an annular chamber 22 formed by two cylindrical walls, a radially inner wall 24 and a radially outer wall 26 that are connected together by a frustoconical downstream wall 28 that converges downstream. An annular ring 30 also has two cylindrical walls, a radially inner wall 32 and a radially outer wall that are connected together by a frustoconical downstream wall 36 that converges downstream, which ring is mounted inside the annular chamber 22 so that the downstream walls 28 and 36 of the annular chamber 22 and of the annular ring 30 come into contact. The annular ring 30 is centered inside the annular chamber 22 by an annular shoulder 38 formed inside the annular chamber 30 at the junction between the frustoconical downstream wall and the inner cylindrical wall 24 of the annular chamber 22.

The annular ring 30 and the annular chamber 22 have respective annular openings at their upstream ends. The cylindrical walls 24 and 26 of the annular chamber 22 project upstream from the upstream ends of the cylindrical walls 32 and 34 of the annular ring 30.

The downstream wall 36 of the annular ring 30 has injection orifices 40 that are regularly distributed circumferentially and that lead into corresponding orifices 42 in the downstream wall 28 of the annular chamber 22. The orifices 40 and 42 of the annular chamber 22 and of the annular ring 30 are identical in diameter.

An inner annular channel 44 is defined between the inner cylindrical walls 24 and 32 of the annular ring 30 and of the annular chamber 22. In similar manner, an outer annular channel 46 is defined between the outer cylindrical walls 26 and 34 of the annular ring 30 and of the annular chamber 22.

The injector device comprises a body 48 having a downstream portion that is annular with a cylindrical duct 50 engaged axially in leaktight manner between the inner and outer cylindrical walls 24 and 26 of the annular chamber 22 and leading in sealed manner to between the inner and outer cylindrical walls 32 and 34 of the annular ring 30. The duct 50 has a radial shoulder 54 that comes into abutment against the upstream ends of the inner and outer cylindrical walls 32 and 34 of the annular ring 30.

This sealed assembly of the body 48 serves to guarantee that the inner and outer annular channels 44 and 46 are sealed from the annular space formed inside the annular ring 30.

A fuel feed arm 56 is connected to the body 48 and comprises two coaxial ducts, namely a central duct 58 that feeds a channel 60 of the body 48 leading downstream to the inside of the annular ring 30, and an outer duct 62 formed around the central duct 58 and feeding distinct channels (not shown) leading to the inner and outer annular channels 44 and 46, respectively.

The body 48 has a fuel collector cavity 64 formed diametrically opposite from the fuel feed arm 56 at the upstream ends of the cylindrical walls 32 and 34 of the annular ring 30 so that the inner and outer annular channels 44 and 46 communicate with the collector cavity 64. A duct 66 is connected at one end to the pilot injector 16 and at the other end to the body 48 and leads into the collector cavity 64.

In operation, the central duct 58 of the arm 56 feeds the channel 60 of the body 48 with fuel, the fuel then flowing in the annular ring 30 and being injected into the combustion chamber downstream via the orifices 40, 42 in the ring 30 and in the chamber 22.

The outer duct 62 of the arm 56 feeds the channels in the body 48 that lead into the inner and outer annular channels 44 and 46, the fuel then flowing into the collector cavity 64 in order to feed the pilot injector 16 via the duct 66.

This circuit forms a pilot circuit and it operates continuously, while the multipoint circuit operates intermittently during specific stages of flight such as takeoffs that require extra power.

During operation of the turbine engine, hot air (at about 600° C.) coming from the high-pressure compressor flows inside the first venturi 12, through the first radial swirler 18, and the air also flows inside the second radial swirler 20, between the first and second venturies 12 and 14.

The inner and outer annular channels 44 and 46 through which the fuel feeding the pilot injector flows continuously form a cooling circuit radially outside and inside the annular ring 30, thereby avoiding fuel coking inside the ring 30 as a result of the thermal radiation of the combustion, with this occurring during stages of flight in which the multipoint circuit is not in operation.

As mentioned above, the front downstream face 28 of the annular chamber 22 is also subjected to the thermal radiation of the combustion, and this can lead to fuel coking in the injection orifices 40 and 42 of the ring 30 and of the annular chamber 22 during stages of flight in which the multipoint circuit is not in use.

Figure 2:
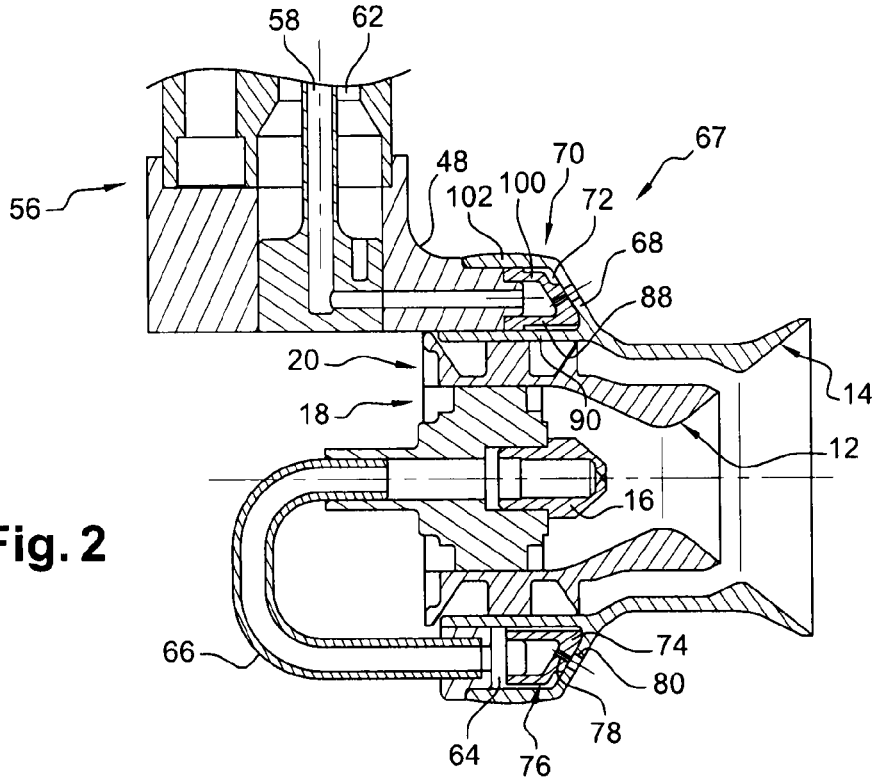
FIG. 2 is a fragmentary diagrammatic axial section view of a multipoint fuel injector device of the invention.
Figure 3:
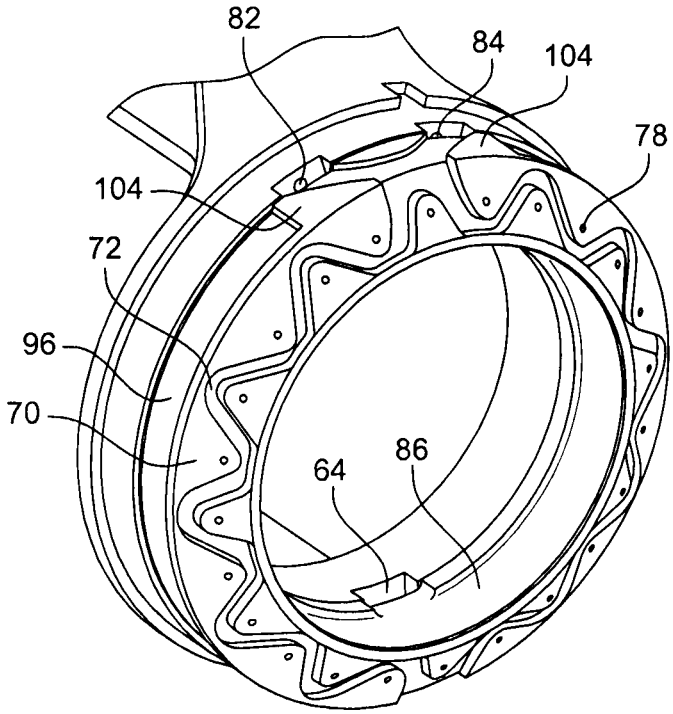
FIG. 3 is a diagrammatic perspective view of the FIG. 2 injector device seen from downstream.
Figure 4:
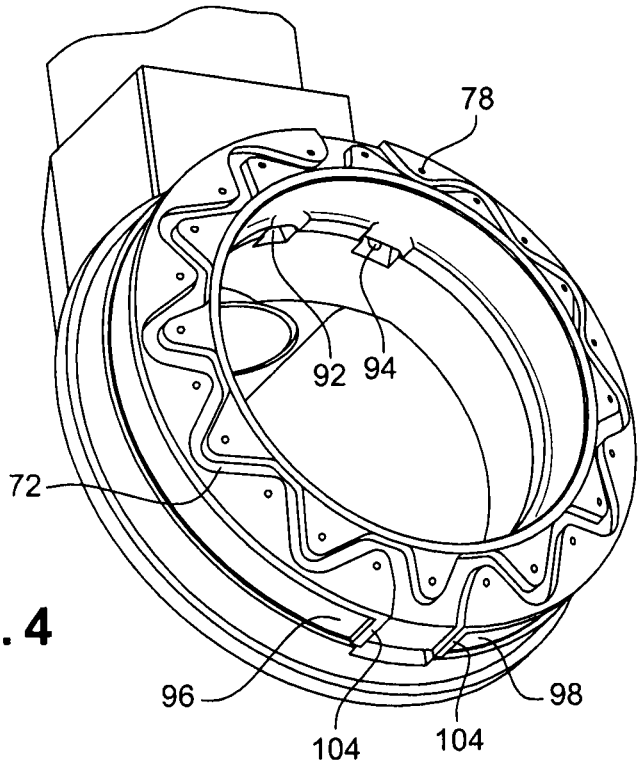
FIG. 4 is a diagrammatic perspective view of the FIG. 2 injector device seen from downstream and at a different viewing angle.

The invention provides a solution to this problem by incorporating a cooling circuit in the injector device 67 for the purpose of cooling the frustoconical front wall 68 of the annular chamber 70 in the immediate vicinity of the injection orifices, as can be seen in FIGS. 2 to 4.

This cooling circuit comprises a groove 72 formed in the downstream face of the frustoconical wall 74 of the annular ring 76, i.e. the face that is pressed against the upstream face of the frustoconical wall 68 of the annular chamber 70.

The groove 72 is of an undulating shape and it extends in alternation radially inside and outside the injection orifices 78 of the annular ring 76, thereby enabling the orifices 78 in the ring 76 and the orifices in the annular chamber 70 to be cooled better. In this embodiment, the groove 72 has two semicircular branches that are fed with fuel by two channels 82 and 84 of the body 48, the outlets of the branches being connected to the diametrically opposite collector cavity 64. The two branches are symmetrical about a plane containing the axis of the pilot injector 16 and lying halfway between the two channels 82 and 84 for feeding the groove 72.

The cooling circuit of the invention also has an inner annular groove 86 formed in the thickness of the inner cylindrical wall 88 of the ring 76, this groove 86 co-operating with the inner cylindrical wall 90 of the annular chamber 70 to define an inner annular channel. The inner annular channel is fed with fuel by two channels 92 and 94 in the body 48, and it is connected at its outlet to the collector cavity 64 in order to cool the inner cylindrical walls 88 and 90 of the annular ring 76 and of the annular chamber 70.

Two semicircular grooves 96 and 98 are formed in the thickness of the outer cylindrical wall 100 of the annular ring 76 and they co-operate with the outer cylindrical wall 102 of the annular chamber 70 to define two semicircular channels having their circumferential ends closed by axial splines 104 of the annular ring 76. In this way, the two outer semicircular channels are isolated from the collector chamber feeding the pilot injector.

During assembly of the ring 76 inside the annular chamber 70, the two semicircular channels 96 and 98 are full of air. In operation, these channels may be full of air if sealing is provided relative to the pilot circuit, and in particular relative to the front circuit, or else, on the contrary, they may be full of fuel, which fuel cokes under the effect of high temperatures. Either way, air or coked fuel forms a thermal insulator, and this is found to be sufficient to avoid fuel coking inside the ring since the outer peripheries of the annular ring 76 and of the annular chamber 70 are subjected to temperatures that are lower than the temperatures to which the inner peripheries of those parts are subjected.

The orifices 78 of the downstream frustoconical wall of the annular ring 76 are of a diameter that is smaller than the diameter of the orifices in the frustoconical front face 68 of the annular chamber 70. This serves, while the multipoint circuit is stopped, to avoid any drops of fuel that remain in the orifices 78 of the annular ring 76 blocking the orifices 80 of the annular chamber 70 by coking. In a particular embodiment, the diameter of the orifices 78 in the annular ring 76 is about 0.5 millimeters (mm), while the diameter of the orifices 80 in the annular chamber 70 is about 1 mm.

In order to insulate the front cooling circuit of the multipoint circuit, the downstream face of the frustoconical wall 74 of the ring 72 is fastened in sealed manner to the frustoconical wall 68 of the annular chamber 70, e.g. by brazing. Thus, the junction between an orifice 78 of the ring 76 and an orifice 80 of the annular chamber 70 is sealed. Instead of using brazing, it is possible to make the annular ring 76 and the second venturi 14 including the annular chamber 70 as a single piece, e.g. by laser sintering.

The invention is not limited to the undulating cooling circuit as described above. It is thus possible to form two grooves in the downstream face of the downstream wall 74 of the ring 76, one of the grooves being situated radially inside the orifices 78 of the ring 76 while the other groove is situated radially outside the same orifices 78. Nevertheless, such a circuit does not provide best cooling of the orifices 78 and 80 in the annular ring 76 and the annular chamber 70, and in particular it does not provide best cooling of the circumferential spaces between the orifices. It is also possible to envisage connecting these inner and outer grooves of the front face by radial channels between the orifices. Nevertheless, that solution would lead to preferred flow forming through some of the channels, thereby leading to non-uniform cooling of the annular ring 76 and of the annular chamber 70.

In another variant, the outer channels 96 and 98 are connected to the collector cavity 64 feeding the pilot injector 16 and they contribute to cooling the annular chamber 70 by the flow of fuel for the pilot injector 16.

The invention claimed is:

1. A fuel injector device for an annular combustion chamber of a turbine engine, comprising:

a pilot circuit that continuously feeds an injector leading into a first venturi;

a multipoint circuit intermittently feeding injection orifices opened downstream and formed in a front face of an upstream annular chamber of a second venturi coaxial about the first venturi;

an annular ring mounted in the annular chamber to define therein a fuel feed circuit that feeds the injection orifices and a cooling circuit that operates by passing fuel that feeds the injector of the pilot circuit, wherein the cooling circuit includes a groove formed in a downstream face of the annular ring in immediate vicinity of the injection orifices, the downstream face of the annular ring being pressed against the front face of the annular chamber.

2. A device according to claim 1, wherein the cooling circuit further comprises an annular channel formed between inner cylindrical walls of the annular ring and of the annular chamber.

3. A device according to claim 1, wherein the cooling circuit further comprises an annular channel formed between outer cylindrical walls of the annular ring and of the annular chamber.

4. A device according to claim 3, wherein the annular channel formed between the outer cylindrical walls of the annular ring and of the annular chamber is configured to be isolated from the pilot circuit and to be filled in operation with air or with coked fuel.

5. A device according to claim 1, wherein the cooling circuit that cools the front face of the annular chamber is of undulating shape and extends in alternation radially inside and outside the injection orifices.

6. A device according to claim 1, wherein the cooling circuit that cools the front face of the annular chamber comprises two symmetrical semicircular branches, each extending between a fuel inlet and a fuel outlet means.

7. A device according to claim 6, wherein the fuel outlet is connected to the injector of the pilot circuit.

8. A device according to claim 1, wherein the downstream face of the annular ring includes fuel-passing orifices leading into the orifices in the front face of the annular chamber.

9. A device according to claim 8, wherein the orifices in the downstream face of the annular ring present a diameter that is less than the diameter of the orifices in the front face of the annular chamber.

10. An annular combustion chamber for a turbine engine, the annular combustion chamber comprising at least one fuel injector device according to claim 1.

11. A turbine engine, a turboprop or a turbojet, comprising at least one fuel injector device according to claim 1.

* * * * *